United States Patent [19]

Yamazaki

[11] Patent Number: 4,800,385

[45] Date of Patent: Jan. 24, 1989

[54] WELL DATA TRANSMISSION SYSTEM USING A MAGNETIC DRILL STRING FOR TRANSMITTING DATA AS A MAGNETIC FLUX SIGNAL

[75] Inventor: Nobuyoshi Yamazaki, Tokyo, Japan

[73] Assignees: Radic Co., Ltd.; Sakata Denki Co., Ltd., both of Tokyo, Japan

[21] Appl. No.: 137,190

[22] Filed: Dec. 23, 1987

[30] Foreign Application Priority Data

Dec. 24, 1986 [JP] Japan ..... 61-306253

[51] Int. Cl.[4] ..... H04B 13/02

[52] U.S. Cl. ..... 340/854; 175/40

[58] Field of Search ..... 340/853–859, 340/870.27, 870.31, 870.32; 175/40, 50; 73/152

[56] References Cited

U.S. PATENT DOCUMENTS

| | | | |
|---|---|---|---|
| 2,411,696 | 11/1946 | Silverman et al. | 340/856 |
| 3,732,728 | 5/1973 | Fitzpatrick | 340/854 |
| 3,967,201 | 6/1976 | Rorden | 340/854 |
| 4,057,781 | 11/1977 | Scherbatskoy | 340/853 |
| 4,302,757 | 11/1981 | Still | 340/854 |

*Primary Examiner*—Deborah L. Kyle
*Assistant Examiner*—John W. Eldred
*Attorney, Agent, or Firm*—Roberts, Spiecens & Cohen

[57] ABSTRACT

A well data transmitting system for use in transmission of a data signal representative of a drilling parameter sensed by a sensor in a drill string of a magnetic material at a bottom of the well drilled by the drill string to a surface station mounted on the earth's surface. A carrier wave is modulated by the data signal and is then applied to a transmitting coil wound on the bottom portion of the drill string to generate a magnetic flux signal induced in the drill string material. The magnetic flux signal is picked up as an electric signal at a coil disposed around an exposed end of the drill string on the earth's surface. The electric signal is equivalent to the modulated signal and is demodulated so that the data signal can be obtained on the earth's surface. The obtained data signal is recorded in a recorder and is processed in a data processor for controlling well drilling operation. When a plurality of sensors are disposed at the well bottom, a sensor selecting signal is transmitted to the bottom as a similar magnetic flux signal through the drill string material.

8 Claims, 4 Drawing Sheets

WELL DATA TRANSMISSION SYSTEM USING A MAGNETIC DRILL STRING FOR TRANSMITTING DATA AS A MAGNETIC FLUX SIGNAL

BACKGROUND OF THE INVENTION (1) Field of the Invention

The present invention relates to a data transmission system for use in telemetry of well drilling parameters such as pressure, temperature, salinity, direction of well bore, bit conditions, and other well logging parameters from well bottom to surface of the earth, and in particular, to such a system useful for a logging while drilling apparatus for logging a well while the well is being drilled.

(2) Description of the Prior Art

In drilling a well such as an oil well by use of a drill string, the well drilling parameters are sensed at the well bottom and are transmitted to surface of the earth.

As a known well data transmission for transmitting data sensed at the well bottom to the surface of the earth, an electric signal is often used as shown in U.S. Pat. No. 2,354,887 (Reference 1) issued to Silverman et al. Reference 1 discloses a data transmitting system wherein a data signal having a varying frequency dependent on the conductivity of the lithospheric layers induces by means of a toroidal coil and a core electric currents varying frequency. The electric currents are transmitted to the earth's surface through a drill string conductor path and the surrounding lithospheric layers. As systems for transmitting data as electric currents, reference is made to U.S. Pat. Nos. 4,057,781 (Reference 2) issued to Scherbatskoy and 4,181,014 (Reference 3) issued to Zuvela et al.

In systems using electric currents for transmitting data, the electric currents are attenuated during transmitting through the lithospheric layers because of variation of its conductivity, so that S/N (signal to noise ratio) degrades considerably. In use of the drill string as the electric current transmission line, a difficulty exists in reliable electrical connection between adjacent interconnected pipes forming the drill string and also in electrical insulation from the surrounding lithospheric layers, so that it is difficult to obtain the electric currents with a high S/N.

Another known system uses an electromagnetic wave as shown in U.S. Pat. No. 4,087,781 (Reference 4) issued to Grossi et al. In Reference 4, a carrier wave is modulated by a data signal sensed at the well bottom and the modulated signal is radiated from an antenna and is transmitted through the surrounding lithospheric layers to the earth's surface. In the system, the electromagnetic wave is also attenuated considerably during transmission through the lithospheric layers, so that a high S/N cannot be insured. As other references disclosing systems using the electromagnetic wave, U.S. Pat. Nos. 3,967,201 (Reference 5) issued to Rorden, 4,090,135 (Reference 6) issued to Farstad et al, and 4,160,970 (Reference 7) issued to Nicolson.

U.S. Pat. No. 4,023,136 (reference 8) issued to Lamensdorf et al discloses a system having a coaxial line formed in the drill string for transmitting the electromagnetic wave therethrough. This system is complicated in structure for forming the coaxial line.

SUMMARY OF THE INVENTION

It is an object of the present invention to provide a well data transmission system which enables one to reliably transmit, with a high S/N, the data sensed at the well bottom to the earth's surface by use of a magnetic drill string material as a data transmission line.

It is another object of the present invention to provide a well telemetry system for sensing and logging the drilling parameters during drilling the well wherein data signal of drilling parameters sensed at the well bottom is transmitted as a magnetic flux signal to the earth's surface through a magnetic drill string material.

It is still another object of the present invention to provide a well telemetry system for sensing and logging the drilling parameters during drilling the well wherein a sensor selecting signal is transmitted as a magnetic flux signal from the earth's surface to the well bottom through a magnetic drill string material.

A well data transmitting system is used in transmission of a data signal representative of drilling parameters sensed at a bottom of the well to an earth's surface, the system comprising a downhole unit disposed at the well bottom for sensing the drilling parameters and a surface station disposed on the earth's surface. According to the present invention, the data transmitting system comprises a tubular drill string being disposed in the well formed by the drill string and being made of magnetic permeable material. The drill string has an upper portion exposed above the earth's surface and a bottom end portion. The downhole unit is disposed in the bottom end portion of the drill string and comprises oscillating an electric means for oscillating carrier wave signal of a predetermined frequency, modulating means for modulating the electric carrier wave signal by the data signal to produce a modulated electric signal, a transmitting coil in the form of a solenoid wound on the bottom end portion of the drill string and coupled to the modulating means. The modulated signal flows through the transmitting coil to thereby induce a magnetic flux signal flowing through the magnetic permeable material of the drill string. A power source is contained in the downhole unit for supplying an electric power to the oscillating means and the modulating means. The surface station comprises a receiving coil in the form of a solenoid wound on the exposed end of the drill string. A received electric signal is induced on the receiving coil by the magnetic flux signal flowing through the magnetic permeable material of the drill string and the received electric signal is equivalent to the modulated signal. Detecting means is coupled with the receiving coil for detecting the data signal from the received electric signal.

According to the present invention, a well telemetry system for sensing and logging the drilling parameters during drilling the well by a drill string is obtained which system comprises the drill string being pipe means made of magnetic permeable material and having bottom end portion adjacent a bottom of the well and an upper portion exposed above the earth's surface, a downhole unit mounted in the bottom end portion of the drill string, and a surface station mounted on the earth's surface. The downhole unit comprises first oscillating means for oscillating a first electric carrier wave signal of a predetermined first carrier frequency, sensing means for sensing at least one of well logging parameters to provide a sensed data signal, first modulating means for modulating the first electric carrier wave signal by the sensed data signal to produce a first modulated electric signal, and a first transmitting coil in the form of a solenoid wound on the bottom end portion of the drill string and coupled to the first modulating means. The first modulated signal flows through the first transmitting coil to thereby induce a first magnetic flux signal flowing through the drill string pipe material. The downhole unit contains a power source for supplying an electric power to the first oscillating means, the sensing means, and the first modulating means. The surface station comprises a first receiving coil in the form of a solenoid wound on the exposed end of the drill string. A first received electric signal is induced on the first receiving coil by the first magnetic flux signal flowing through the drill string pipe material and the first received electric signal is equivalent to the first modulated signal. A first detecting means is coupled with the first receiving coil for detecting the sensed data signal from the first received electric signal.

In order to supply a sensor selecting signal from the surface station to the downhole unit, the surface station can be provided with means for producing a sensor selecting signal, second oscillating means for oscillating a second electric carrier wave signal of a predetermined second carrier frequency, second modulating means for modulating the second electric carrier wave signal by the sensor selecting signal to produce a second modulated signal, and second transmitting coil in the form of a solenoid wound on the exposed end of the drill string and coupled with the second modulating means. The second modulated signal flows through the second transmitting coil to thereby induce a second magnetic flux signal flowing through the drill string pipe material. The downhole unit also can be provided with a second receiving coil in the form of a solenoid wound on the bottom end portion of the drill string. A second received electric signal is induced on the second receiving coil by the second magnetic flux signal flowing through the drill string pipe material. A second detecting means is coupled with the second receiving coil for detecting the sensor selecting signal from the second received electric signal. The sensing means comprises a plurality of different sensor elements for sensing different logging parameters, respectively, and selecting means coupled with the second detecting means for permitting a selected one of the plurality of sensor elements to carry out the sensing operation in response to the detected sensor selecting signal. Thus, the sensing means produces, as the sensed data signal, a data signal sensed by the selected one of the plurality of sensor elements.

The power source in the downhole unit may be an electric cell.

The surface station may have a recording means for recording the detected data signal. Further, the surface station may have a processor for processing the detected data signal so as to display the data on a display unit and/or to use the data for controlling well drilling operation.

DESCRIPTION OF THE PREFERRED EMBODIMENTS

Figure 1:
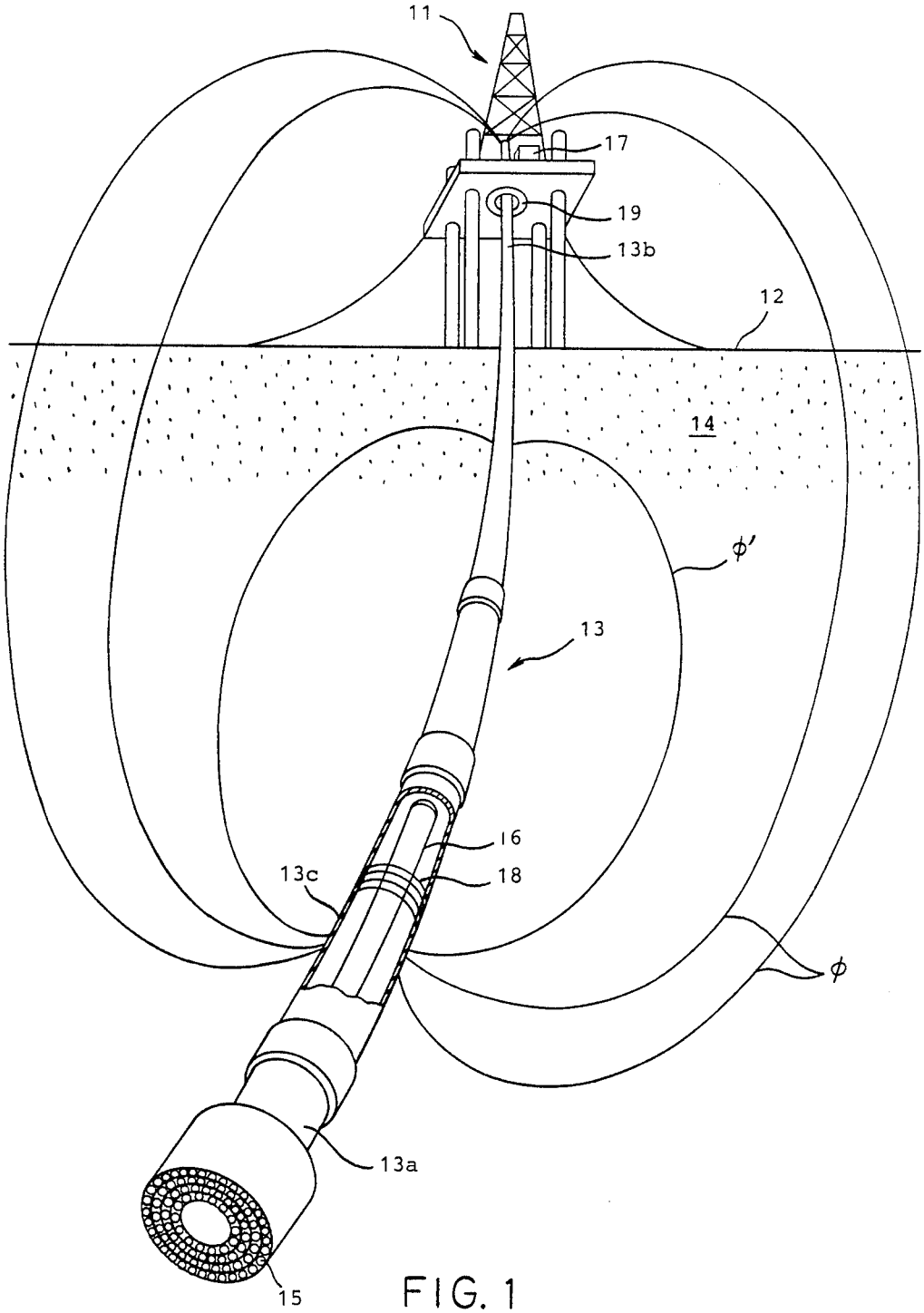
FIG. 1 is a schematic cross-sectional view of the lithospheric layers in which a well is formed by a drill string together with a well data transmission system according to an embodiment of the present invention.

Referring to FIG. 1, a drilling rig 11 is mounted on the earth's surface 12. A tubular drill string 13 downwardly extends from the drilling rig 11 into the lithospheric layers 14 of the earth to form a well. The drill string 13 comprises a number of interconnected pipes made of magnetic permeable, hard, and strong material, for example, steel pipes, and a drill collar 13*a* including a drill bit 15 at an extending end at a bottom end of the well. The drill string 13 has a portion 13*b* exposed above the earth's surface 12. The exposed portion 13*b* is connected to a known rotary and driving apparatus (not shown) mounted on the rig 11 and is rotated and driven downwardly by the apparatus so as to drill the well.

A downhole unit 16 is mounted in the drill string 13 near the drill bit 15, for example, in a pipe 13*c* adjacent to and just above the drill collar 13*a*. The downhole unit 16 serves for sensing well drilling parameters such as pressure, temperature, salinity, direction of well bore, and bit conditions and for transmitting the sensed data to a surface station 17 mounted on the earth's surface.

The downhole unit 16 is provided with a coil unit 18 which is fixedly mounted on the outer surface of the pipe 13*c*. The surface station 17 is also provided with a coil unit 19 which is fixedly mounted on the rig 11 and is disposed around the exposed end 13*b* of the drill string 13. Each of the coil units 18 and 19 comprises a transmission coil each and in the form of a solenoid receiving coil as will be described hereinafter in connection with FIGS. 3 and 4.

Figure 2:
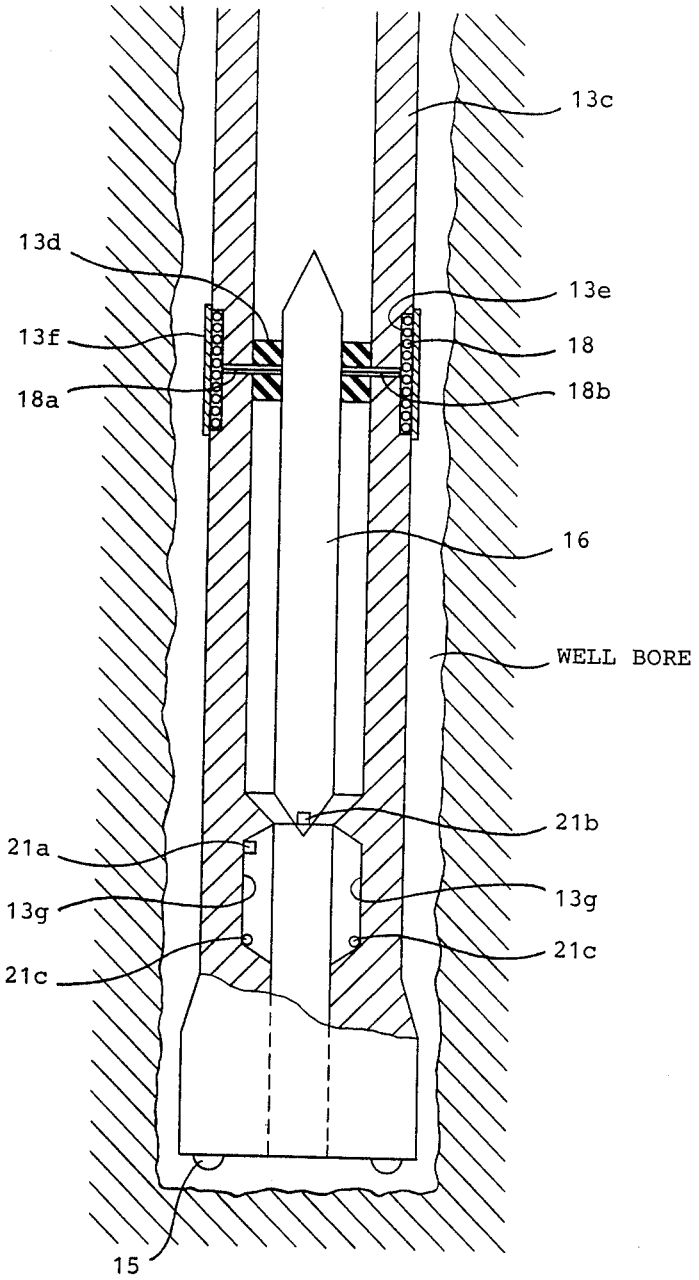
FIG. 2 is an enlarged sectional view of a bottom end portion of the drill string shown in FIG. 1.

Referring to FIG. 2, the downhole unit 16 comprises a water tight casing of a stainless steel in which electric circuits and an electric cell are housed. The downhole unit 16 is fixedly supported within the pipe 13*c* by supports 13*d* of insulating material or stainless steel. The pipe 13*c* is formed with an outer annular groove 13*e* in the outer surface of the pipe 13*c*. The coil unit 18 is wound in the groove 13*e* and is cured by a plastic resin over which a stainless steel cover 13*f* is wound. The coil 18 is made of an insulated wire and the wire leads are introduced into the downhole unit 16 through the pipe 13*c* and supports 13*d* as shown at 18*a* and 18*b* in the figure. Two recesses 13*g* are formed in the inner surface of the pipe 13 at a lower position of the downhole unit 16. Sensor elements 21*a*, 21*b*, and 21*c* are mounted in the recesses 13*g*.

Figure 3:
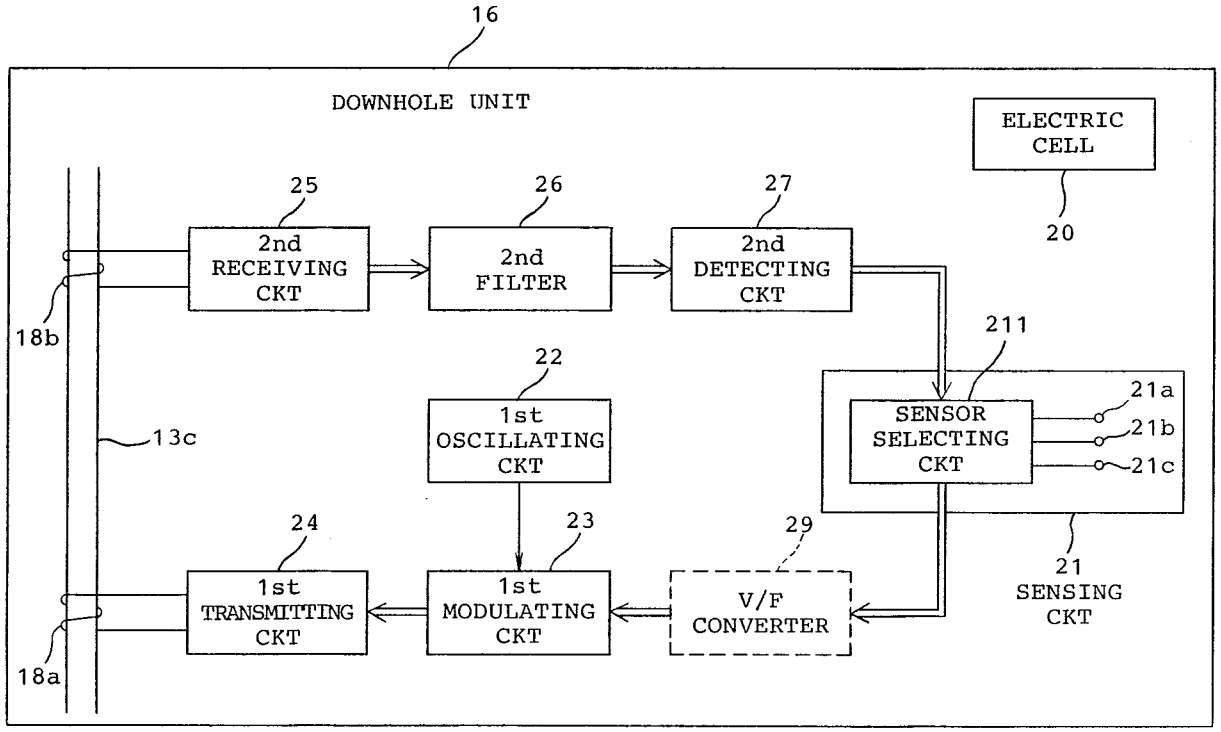
FIG. 3 is a block diagram view of a downhole unit shown in FIG. 1.

Referring to FIG. 3, the downhole unit 16 comprises a power source 20 for supplying electric power to various electric circuits in the unit 16 and a sensing circuit 21. As the power source 20, a proper electric cell is used by selecting one from various primary and secondary electric cells. The sensing circuit 21 comprises a plurality of sensor elements, for example, a temperature sensor such as a thermister, a pressure sensor such as a wire strain gage, and a bit condition sensor such as a torque meter as shown at 21*a*, 21*b*, and 21*c* in FIGS. 2 and 3. The sensing circuit 21 further comprises a sensor selecting circuit 22 for selectively driving one of the sensor elements 21*a*, 21*b*, and 21*c* in response to a sensor selecting signal which will later be described. The sensing circuit 21 produces a sensed data signal representative of data sensed by the selectively driven sensor 21*a*, 21*b*, or 21*c*.

The downhole unit 16 further comprises a first oscillating circuit 22 for oscillating a first electric carrier wave signal of a predetermined first carrier frequency, for example, 10 kHz. The first electric carrier wave signal is modulated by the sensed data signal from the sensing circuit 21 at a first modulating circuit 23 to produce a first modulated signal. The first modulated signal is power-amplified in a first transmitting circuit 24 from which the first modulated signal is supplied to a first transmitting coil 18*a* of the coil unit 18.

When the first modulated signal flows through the first transmitting coil 18*a*, a first magnetic flux signal is induced and flows through the steel material of the drill string 13. The first magnetic flux signal further emits from an exposed end of the drill string 13 into the atmosphere and returns to the bottom portion of the drill string 13 through the lithospheric layers 14. The magnetic fluxes flowing through the atmosphere and the lithospheric layers 14 are shown at $\phi$ in FIG. 1.

Since the magnetic flux having the first carrier frequency flows through the coil unit 19, an electric signal is induced in the coil unit 19 as a first received signal which is equivalent to the first modulating signal.

Although the magnetic fluxes leak into the lithospheric portions from various side wall portions on the way to the exposed end potion 13*b* from the bottom end portion 13*c* along the drill string 13 as leakage magnetic flux shown at $\phi'$ in FIG. 1, the leakage is very small because the magnetic permeability of the drill string 13 is larger than that of the lithospheric layers 14. Further, even if a small magnetic gap exists at each interconnection point of adjacent pipes of the drill string 13, leakage of the magnetic fluxes is small, so that the major portion of the magnetic flux signal reliably flows through the coil unit 19. Therefore, the S/N ratio of the signal to be transmitted through the drill string 13 is maintained high.

Figure 4:
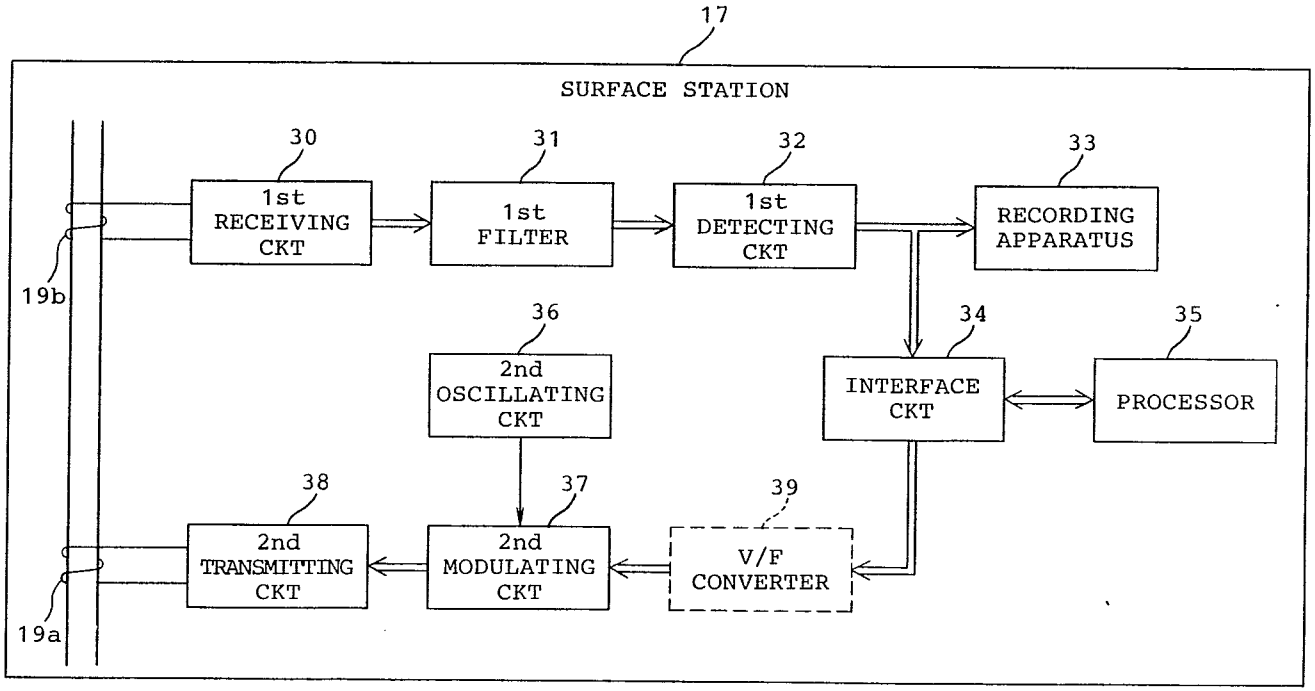
FIG. 4 is a block diagram view of a surface station shown in FIG. 1.

Referring to FIG. 4, the surface station 17 comprises a first receiving circuit 30 coupled to the first receiving coil 19*b* of the coil unit 19. The first received signal induced in the first receiving coil 19*b* is applied to the first receiving circuit 19 and amplified thereat. Then, the first received signal is filtered through a first electric filter 1 having a center frequency equal to the first carrier frequency of 10 kHz and is applied to a first detecting circuit 32. Accordingly, any noise is eliminated at the filter 31. The first detecting circuit 32 detects the sensed data signal from the first received signal. The detected data signal is applied to a recording apparatus 33 and is recorded on a recording medium, such as a recording paper, in the recording apparatus 33.

The surface station 17 further comprises an interface circuit 34 through which the detected data signal is applied to a processor 35. The processor 35 receives the detected data which is, in turn, displayed on a cathode ray tube (CRT) accompanied with the processor 35.

Therefore, the well drilling parameters can be readily known at the surface station and the rotary and driving apparatus can therefore be controlled in the optimum conditions in dependence on the known drilling parameters.

In order to selectively drive one of the plurality of sensors 21*a*–21*c*, a sensor selecting signal is supplied from the processor 35 to the downhole unit 16.

To this end, the surface station 17 comprises a second oscillating circuit 36 for oscillating a second electric carrier wave signal of a second carrier frequency of, for example, 5 kHz. The second electric carrier wave signal is modulated by the sensor selecting signal at a second modulating circuit 37 to produce a second modulated signal which is, in turn, power-amplified in a second transmitting circuit 38, then applied to the second transmission coil 19*a* of the coil unit 19.

When the second modulated signal flows through the second transmission coil 19*a*, , a second magnetic flux signal is induced and flows in the steel pipe material of the drill string 13. As a result, an electric signal equivalent to the second modulated signal is also induced in the coil unit 18 as a second received electric signal.

Now, returning to FIG. 3, the downhole unit 16 further comprises a second receiving circuit 25 coupled with a second receiving coil 18*b* of the coil unit 18. The second received electric signal induced in the second receiving coil 18*b* is amplified in the second receiving circuit 25 and is filtered at a second electric filter 26 having a central frequency equal to the second carrier frequency of 5 kHz. Accordingly, any noise is eliminated at the filter 26. The filtered signal is applied to a second detecting circuit 27 which detects the sensor selecting signal from the filtered signal equivalent to the second modulated signal. The sensor selecting signal is applied to the sensing circuit 21.

The sensor selecting circuit 211 in the sensing circuit 21 selects one of the sensor elements in response to the selecting signal, and the selected one of the sensors carries out its sensing operation to produce a sensed data signal, as described above.

In the above-described operation, when the first magnetic flux signal flows through the steel pipe material of the drill string 13, an electric signal is induced in the second receiving coil 18*b* of the coil unit 18. The induced electric signal is equivalent to the first modulated signal and is, therefore, attenuated at the second filter 26. In similar manner, an electric signal is induced in the first receiving coil 19*b* of the coil unit 19 by the second magnetic flux, but it is also attenuated at the first filter 31.

In the first or second modulating circuit 23 or 37, various modulating methods can be employed. Preferably, PWM, PFM, or PCM is used for the modulation.

In FIG. 3, when the sensed data signal from the sensing circuit 21 is a voltage signal, a voltage-to-frequency (V/F) converter 29 may be used as shown by a broken line box in FIG. 3 to convert the voltage signal into a frequency signal which is applied to the first modulating circuit 23 to modulate the first carrier wave. In similar manner, when the sensor selecting signal from the interface 34 in FIG. 4 is a voltage signal, a V/F converter may be used as shown at 39 in FIG. 4 for converting the voltage signal into a frequency signal before it is supplied to the second modulating circuit 37.

The above embodiments have been described in connection with a rotary type well drilling apparatus wherein the drill string is rotated during drilling, it will be understood by those skilled in the art that the present invention can be applied to a non-rotary type well drilling apparatus wherein a drill string having a corn shape end is forced into the lithospheric layers by a downward pressing force.

What is claimed is:

1. A well data transmitting system for use in transmission of a data signal representative of drilling parameters sensed at a bottom of a well to the earth's surface, said system comprising a downhole unit disposed at the wall bottom for sensing the drilling parameters and a surface station disposed on the earth's surface, which comprises:

a tubular drill string disposed in the well formed by the drill string and being made of magnetic permeable material, said drill string having an upper portion exposed above the earth's surface and a bottom end portion;

said downhole unit being disposed in said bottom end portion of said drill string and said downhole unit comprising;

oscillating means for oscillating an electric carrier wave signal of a predetermined frequency;

means for producing data signal corresponding to at least one drilling parameter;

modulating means for modulating said electric carrier wave signal by said data signal to produce a modulated electric signal;

a transmitting coil in the form of a solenoid wound on said bottom end portion of said drill string and coupled to said modulating means, said modulated signal flowing through said transmitting coil to thereby induce a magnetic flux signal flowing through said magnetic permeable material of said drill string; and a power source for supplying electric power to said oscillating means, and said modulating means;

said surface station comprising:

a receiving coil in the form of a solenoid disposed around said upper portion of the drill string, a received electric signal being induced in said receiving coil by said magnetic flux signal flowing through said magnetic permeable material of said drill string, said received electric signal being equivalent to said modulated signal; and detecting means coupled with said receiving coil for detecting said data signal from said received electric signal.

2. A well telemetry system for sensing and logging the drilling parameters during drilling a well by a drill string, which comprises:

said drill string being pipe means made of magnetic permeable material, said drill string having a bottom end portion adjacent to bottom of said well and an upper portion exposed above the earth's surface;

a downhole unit mounted in said bottom end portion of said drill string and comprising:

first oscillating means for oscillating a first electric carrier wave signal of a predetermined first carrier frequency;

sensing means for sensing at least one of well logging parameters to provide a sensed data signal;

first modulating means for modulating said first electric carrier wave signal by said sensed data signal to produce a first modulated electric signal;

a first transmitting coil in the form of solenoid wound on said bottom end portion of the drill string and coupled to said modulating means, said first modulated signal flowing through said first transmitting coil to thereby induce a first magnetic flux signal flowing through said drill string pipe material; and a power source for supplying electric power to said first oscillating means, said sensing means, and said first modulating means;

a surface station mounted on the earth's surface and comprising:

a first receiving coil in the form of a solenoid disposed around said upper portion of the drill string, a first received electric signal being induced on said first receiving coil by said first magnetic flux signal flowing through said drill string pipe material, said first received electric signal being equivalent to said first modulated signal; and first detecting means coupled with said first receiving coil for detecting said sensed data signal from said first received electric signal.

3. A well telemetry system as claimed in claim 2, wherein said surface station further comprises:

means for producing a sensor selecting signal;

second oscillating means for oscillating a second electric carrier wave signal of a predetermined second carrier frequency;

second modulating means for modulating said second electric carrier wave signal by said sensor selecting signal to produce a second modulated signal; and a second transmitting coil in the form of a solenoid disposed around said upper portion of the drill string and coupled with said second modulating means, said second modulated signal flowing through said second transmitting coil to thereby induce a second magnetic flux signal flowing through said drill string pipe material;

and wherein said downhole unit further comprises.

a second receiving coil in the form of a solenoid wound on said bottom end portion of the drill string, a second received electric signal being induced in said second receiving coil by said second magnetic flux signal flowing through said drill string pipe material;

second detecting means coupled with said second receiving coil for detecting said sensor selecting signal from said second received electric signal;

said sensing means comprising a plurality of different sensor elements for sensing different logging parameters, respectively, and selecting means coupled with said second detecting means for permitting a selected one of said plurality of sensor elements to carry out the sensing operation in response to said detected sensor control signal, said sensing means producing, as said sensed data signal, a data signal sensed by said selected one of said plurality of sensor elements.

4. A well telemetry system as claimed in claim 3, wherein said surface station further comprises first filter means having a pass band of a central frequency equal to said first carrier frequency and coupled with said first receiving coil means, said first filter means permitting said first received electric signal to pass therethrough and to be applied to said first detecting means.

5. A well telemetry system as claimed in claim 3, wherein said downhole unit further comprises second filter means having a pass band of a central frequency equal to said second carrier frequency and coupled with said second receiving coil means, said second filter means permitting said second received electric signal to pass therethrough and to be applied to said second detecting means.

6. A well telemetry system as claimed in claim 2, wherein said power source in said downhole unit is an electric cell.

7. A well telemetry system as claimed in claim 2, wherein said surface station further comprises recording means coupled with said first detecting means for recording said sensed data signal thereinto.

8. A well telemetry system as claimed in claim 2, wherein said surface station further comprises data processor means coupled with said first detecting means for processing said sensed data.

* * * * *

UNITED STATES PATENT AND TRADEMARK OFFICE

CERTIFICATE OF CORRECTION

PATENT NO. : 4,800,385

DATED : January 24, 1989

INVENTOR(S) : Yamazaki

It is certified that error appears in the above-identified patent and that said Letters Patent is hereby corrected as shown below:

Claim 1, Column 6, line 64; change "wall" to --well--

Signed and Sealed this

Tenth Day of October, 1989

*Attest:*

DONALD J. QUIGG

*Attesting Officer*

*Commissioner of Patents and Trademarks*